United States Patent [19]

Smith

[11] 4,445,414

[45] May 1, 1984

[54] DIGITAL, SIMULTANEOUS, DISCRETE FREQUENCY GENERATOR

[75] Inventor: Burrell Smith, Palo Alto, Calif.

[73] Assignee: Apple Computer, Inc., Cupertino, Calif.

[21] Appl. No.: 351,653

[22] Filed: Feb. 24, 1982

[51] Int. Cl.[3] ..... G10H 7/00

[52] U.S. Cl. ..... 84/1.01; 328/16; 364/770

[58] Field of Search ..... 84/1.01; 328/16–18; 364/770

[56] References Cited

U.S. PATENT DOCUMENTS

| | | | |
|---|---|---|---|
| 3,989,940 | 11/1976 | Kihara | 364/770 |
| 4,134,321 | 1/1979 | Woron | 84/1.24 X |
| 4,198,892 | 4/1980 | Gross | 84/1.24 X |
| 4,256,003 | 3/1981 | Deutsch | 84/1.01 |
| 4,269,101 | 5/1981 | Deutsch et al. | 84/1.01 |
| 4,333,374 | 6/1982 | Okumura et al. | 84/1.01 |
| 4,338,674 | 7/1982 | Hamada | 84/1.01 X |
| 4,345,500 | 8/1982 | Alonso et al. | 84/1.01 |
| 4,351,212 | 9/1982 | Okamoto et al. | 84/1.01 |

*Primary Examiner*—Stanley J. Witkowski

*Attorney, Agent, or Firm*—Blakely, Sokoloff, Taylor & Zafman

[57] ABSTRACT

A waveform of arbitrary complexity may be generated using a minimal number of circuit elements and minimal complexity by generating a frequency domain from a minimum set of base frequencies by storing lower octave frequencies of the minimal base set within a note memory. Selected octave and pitch, or note may be read from the note memory according to a list of notes to be thusly read as stored within a note list memory. Each of the instantaneous values of the base frequencies read from the note memory is then added in an accumulator to represent the instantaneous value of the sum of notes or tones comprising the complex frequency at that time. The application of process time periods will replicate an arbitrary complex waveform. Such a frequency generator can find wide application within electronic musical devices, tests and analysis instrumentation, communications and many other fields.

5 Claims, 1 Drawing Figure

DIGITAL, SIMULTANEOUS, DISCRETE FREQUENCY GENERATOR

BACKGROUND OF THE INVENTION

1. Field of the Invention

The present invention relates to the field of digital frequency synthesizers and in particular, relates to musical tone generators and frequency synthesizers.

2. Prior Art

Frequency synthesizers are categorized as either analog or digital. In each category generators have been devised to produce one frequency at a time or multiple frequencies simultaneously.

Analog frequency synthesizers have been generally characterized by requiring a distinct electrical component for each discrete frequency. In other words, to create a number of frequencies an equal number of components such as resistors, inductors, switching circuitry or oscillators are required to simultaneously create the same number of frequencies. Complex switching circuits are devised to control switching between a smaller number of controlling components and a larger number of controlled oscillators, or tone generators. Large and complex circuits are the result.

The design or digital circuitry often parallels prior analog circuitry used for simultaneous generation of frequencies. Such digital circuits also incorporate a generally linear increase in component count with an increase in the number of frequencies generated. For example, a separate oscillator is required for each frequency, such as a flip-flop, phase-locked-loop or monostable oscillator. Electronic or mechanical switching between frequency determining components such as resistors or crystals is also used in order to control as many oscillators as frequencies which are required. A small set of fixed frequencies may be heterodyned to create a larger set of frequencies. In the heterodyning method, switching complexity increases as the number of simultaneous frequencies also increases. In addition, when heterodyning the set of fixed frequencies necessarily becomes even larger when the frequencies which are ultimately desired are not simply related. When digital counters are used as the basic element in frequency generators, the result is that the number of digital counters required equals the number of desired frequencies. The prior art uses a small number of separate oscillators to clock a number of counters to provide in turn a multiplicity of low frequency signals. Each desired frequency thus requires a separate counter. Shift registers have been used in the same manner as counters to produce a multiplicity of low frequency signals.

What is needed then is circuitry and a methodology for simultaneously producing a large number of frequencies without necessitating a corresponding increase in the number of separable elements required to generate the number of discrete frequencies desired.

BRIEF SUMMARY OF THE INVENTION

The present invention is an apparatus for simultaneously generating a multiple of frequencies comprising a means for generating a plurality of base frequencies, a note memory, a comparison means, and an incrementing means. The base frequency generating means is coupled to the note memory which is used for storing as many corresponding words as the number of the plurality of base frequencies. The comparison means is coupled to the note memory and addresses the memory and compares the lowest order of bits of each word in the note memory to the corresponding base frequency. The rate of comparison of the comparison means is greater than the highest base frequency. The incrementing means conditionally adds one to the corresponding word in note memory if the comparison generated by the comparison means indicates an inequality between the base frequency and the lowest order bit of the addressed word. By a combination of these elements, octaves of each of the base frequencies are generated for simultaneous output.

In another embodiment of the present invention the invention further comprises a note list memory for storing addresses and bit location codes of selected words in the note memory. A bit means is provided for selectively reading every address and bit location code in the note memory and for addressing a selected bit from the selected words in the note memory. An output means adds each of the selected bits and generates a sum output signal. By virtue of these additional elements, an arbitrary waveform may be generated from the base frequencies.

The following figures show one embodiment of the present invention whereby simultaneous multiple frequencies may be generated according to the present invention. Like elements are referenced by like numerals.

DETAILED DESCRIPTION OF THE INVENTION

Figure 1:
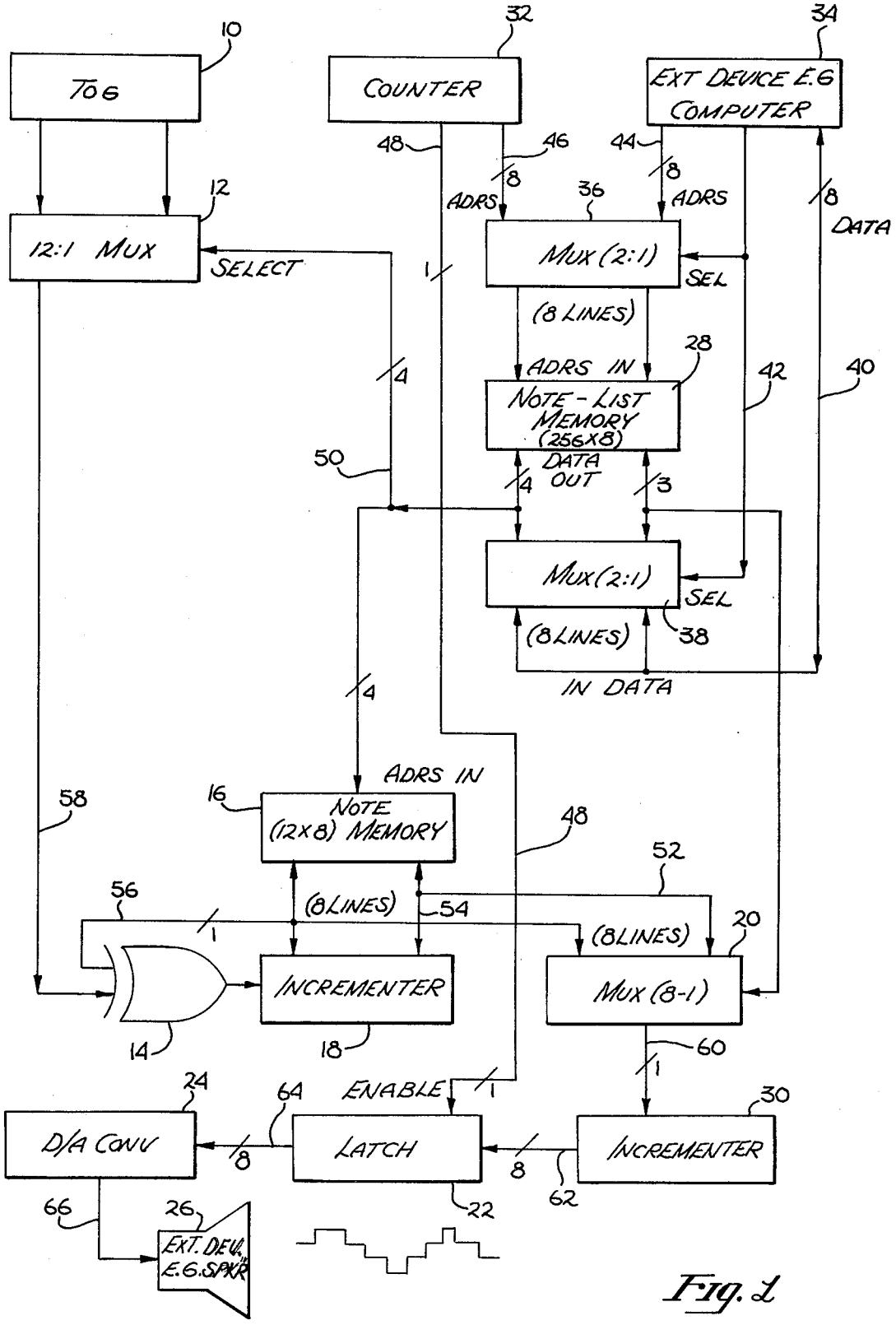
FIG. 1 is the sole FIGURE which illustrates in simplified block form one circuit organization which can be utilized to achieve the objects of the invention.

The present invention is a generator for simultaneously producing multiple frequencies and differs from the prior art in that there is no increase in the complexity or number of circuit elements as the number of simultaneous frequencies desired increases. The present invention maximizes the efficiency by which memory can be utilized to produce simultaneous frequencies by utilizing a single bit to produce each frequency. In the illustrated embodiment, a musical tone generator is described, although the same principles could be applied using ordinary skills in the art according to the present teachings in order to devise a generalized frequency synthesizer. In addition, the illustrated embodiment will show the generation of a squarewave tone. However, it is well understood that sinusoidal, triangular or any other non-rectangular waveforms can be easily generated based upon the rectangular waveforms using well-known waveform generation techniques including, but not limited to, Walsh functions.

According to the basic principle of the invention a plurality of base frequencies or pitches are generated from which a multiple number of octaves are constructed. In other words, the musical scale is generated in the highest octave and all lower octaves desired are derived therefrom. This can be readily accomplished in the present invention by noting that each higher order bit in a binary word changes as the number increases in unit steps at half the frequency as the next lower order bit. Thus, by adding one to the lowest order bit of a binary word, the various bits in the word form a representation of as many octaves as there are bits. Thus, a single binary word can represent a number of different octaves of a single tone or pitch. In the chromatic scale, twelve tones comprise the octave. These twelve tones are generated by a conventional top octave generator 10 (hereinafter TOG). A chromatic scale is described only for the purposes of illustration and in no way is it intended to limit the scope of the present invention. Clearly, many other scales or relationships between a set of base frequencies can be selected according to the application and objectives at hand. For example, the base frequencies may be numerically generated by a computer or may be produced by a fixed memory.

The twelve output lines of TOG 10 are coupled to a multiplexer 12. The output of multiplexer 12 is coupled to an exclusive-OR gate 14. A random access memory, or note memory 16 provides memory capacity for twelve words, each of eight bits in length. In the illustrated embodiment, eight bit words are chosen inasmuch as this is a convention within the industry and moreover, eight octaves are usually sufficient to provide a full dynamic range for a musical instrument. The lowest order output bit of note memory 16 is coupled as the other input to exclusive-OR gate 14. The output of OR gate 14 is coupled to an incrementer 18 whose output is coupled to the accessed word location from note memory 16.

Thus, the basis of the operation of the present invention can be understood by just these few elements. The selected pitch, or tone from TOG 10 is coupled through a multiplexer 12 to exclusive-OR gate 14. Gate 14 will present a 1 to incrementer 18 in the event that the least significant bit of the accessed word from note memory 16 is different than the value of the base frequency selected from TOG 10 during that clocked period and otherwise presents a 0 output if the least significant bit from the accessed word and the selected pitch from TOG 10 are the same. If the value stored in memory is different than that present on the selected pitch of TOG 10, the word in memory is incremented by 1, (the output of exclusive-OR gate 14) and stored back into note memory 16 at the same accessed address. By selecting the comparison or clock rate to be greater than the highest frequency of the plurality of base frequencies generated by TOG 10, one can always be assured that the contents of note memory 16 have been updated during a period of time so small that none of the waveforms generated by TOG 10 have changed. In the illustrated embodiment, it is sufficient to drive the circuitry of FIG. 1 by a conventional clock at a rate twice the highest frequency generated by TOG 10 in order to assure this result.

The output of note memory 16 is also coupled to multiplexer 20. Thus, the eight octaves represented by a pitch contained in a single word of memory is presented to the inputs of multiplexer 20. As will be described below in greater detail, the output of multiplexer 20 ultimately will be coupled to a latch 22 and a digital-to-analog converter 24 for conversion into an audio signal through the speaker 26 to produce the selected note. The note can be arbitrarily selected according to conventional principles well-known to the art. Pitch can be selected by addressing note memory 16 and the octave selected by controlling multiplexer 20 according to the present teachings.

Another aspect of the present invention can now be understood by reviewing the remaining elements within the circuitry of FIG. 1. The present invention is particularly adapted to a convenient method and means for presenting an arbitrary output waveform. In the illustrated embodiment, a note list word may be constructed on a 3-bit field comprising a bit location code representing the selected octave of any given pitch. Similarly, a 4-bit field comprises a pitch location code and is capable of representing any one of the twelve pitches within each corresponding octave. Thus, a 7-bit word, formed of a 3 and 4 bit field, is capable of indicating any one of the 96 different notes which the illustrated embodiment is capable of generating. By an expansion of these principles, any greater or lesser scale can also be represented without undue complication or proliferation of circuitry.

Note list memory 28 is a random-access memory capable of storing these 7-bit words. In the illustrated embodiment, in fact, note list memory 28 is a memory comprised of 256 bytes. Although note list memory 28 and note memory 16 have been shown and described as separate memories, it is clear that they may in fact be distinguishable portions of the same memory elements or organized in any other equivalent fashion. Note list memory 28 and note memory 16 have been shown and described herein as separate memories solely for the purposes of clarity of explanation and ease of understanding. In addition, note list memory 28 may be substantially larger than 256 words and in fact may be as large as practical to include as many different notes as may be required during any given time period to represent a complex output waveform.

The 4-bit pitch location field is coupled from note list memory 28 to multiplexer 12 to select the appropriate base frequency from TOG 10 as described above and to the address input of note memory 16 in order to simultaneously present the appropriate pitch word at the output of note memory 16. The 3-bit location code or octave field is simultaneously presented at the output of note list memory 28 and is coupled to multiplexer 20 wherein the appropriate octave of the selected pitch is coupled to an incrementer, or accumulator 30. A conventional counter 32 passes through the entire address domain or note list memory 28 to read the entire contents of memory 28 in order to call forth from memory 16 all the notes required for the simultaneous creation of the complex frequency. Each of these selected bits are accumulated in accumulator 30. When the entire contents of note list memory 28 have been read by counter 32, latch 22 is enabled by counter 32 and the contents of accumulator 30 is latched therein. Digital-to-analog converter 24 converts the digital signal stored at that moment in latch 22 into a corresponding analog voltage level.

The entire contents of note list memory 28 are read out at a rate higher than the highest desired output frequency in order to insure that the proper value of the selected octaves based upon the frequencies of TOG 10 are accumulated in accumulator 30. By the time that the last frequency output of TOG 10 changes value, note list memory 28 will be scanned at least twice again to select the various pitches and sub-octaves as specified in the note list contained within note list memory 28. If a pitch in note memory 16 is not contained in note-list memory 28, it will not be updated. However, when the pitch does appear in note-list memory 28, it will be updated. Inasmuch as only the oscillation rate of the bits in note memory 16 are significant and not the magnitude of the stored number, the time at which updating commences or ceases is irrelevant.

Information in note list 28 is controlled by an external device or computer 34 of any type well-known to the art. In the illustrated embodiment, the entire contents of note-list memory 28 can be changed between any given clock cycle by reading in a new list through multiplexer 38 under the address control of multiplexer 36. In other words, the address locations in note-list memory 28 are provided by external user device 34, such as through software control, by coupling the address through 2-to-1 multiplexer 36. Simultaneously therewith, the note memory addresses are read into the selected locations in note-list memory 28 through 2-to-1 multiplexer 38 on a data bus line 40 from user 34. Multiplexers 36 and 38 are controlled by a select line 42 again controlled by user 34 in order to appropriately select either data and addresses from user 34 or addresses from counter 32. Data bus 40 is also bidirectional to allow the contents of note list memory 28 to be read through multiplexer 38 for any purpose desired by user 34.

Although the present invention has been described in connection with the specifically illustrated embodiment as shown in FIG. 1, many other applications or alterations may be made in the present invention without departing from its spirit and scope. For example, additional circuitry may be added according to well-known design principles by following the present teachings to add amplitude information or to directly generate non-rectangular waveforms. The amplitude of any given note may increased in the illustrated embodiment by simply including that note several times in the note list memory. Alternatively, additional memory may be provided to store amplitude information which can be then used to multiply or amplify the digital analog data by any conventional means. In other words, an amplitude field could likewise be included within the words of the note list memory 28 in the same manner and the octave and pitch fields.

Although generation of the notes within note memory 16 have been shown by a combined use of exclusive-OR gate 14 and incrementer 18, many other alternative means may also be included such as reading the word into a register, adding one into the register and then rewriting the word back into the same memory location; or using note memory 16 in such a manner that each word location is an accumulator.

In addition, other fields within the words stored in note list memory 28 may be created and utilized in various applications. For example, a bit may be reserved to indicate if a certain word should be skipped. This would be of use where all the notes in note memory 16 were constantly updated but only those indicated by note-list memory 28 were to produce an audible note. One or more bits may also be reserved to indicate which of two or more channels of which the output should be directed.

Although the present invention has been described as a musical tone generator, it must be clearly understood that this application is merely a single preferred embodiment of the inventive concept which can be employed productively in many other situations. For example, the present invention may be used to analyze an arbitrary waveform by successively approximating the waveform by generating a series of iterations by a circuit of the type shown in FIG. 1. An external computer can be used to make the comparative analysis at each step of the iteration and to provide the appropriate feedback parameters to the circuitry of FIG. 1 for the next approximation. The speed of the circuitry of FIG. 1 is such that waveform analysis of this type can be easily accomplished.

Thus, what has been devised is a voice, or tone generator of heretofore unobtainable speed, flexibility and simplicity. In the prior art, a 256 voice generator required hundreds of integrated circuit packages whereas a prototype of the present invention was capable of functioning as a 256 voice generator with approximately 20 integrated circuits. Thus, the circuitry in the present invention is capable of applications, not only within the field of musical instrumentation but also within the fields of test and analysis instrumentation, communications, and many other fields as well.

I claim:

1. An apparatus for generating simultaneous multiple frequencies comprising:

base frequency means for generating a plurality of base frequencies;

note memory for storing as many corresponding words as the number of said plurality of base frequencies;

comparison means for comparing the lowest order bit of each said word in said note memory to said corresponding base frequencies, said comparing occurring at a higher rate than the highest base frequency; and increment means for adding 1 to said corresponding word in said note memory if comparison by said comparison means indicates inequality between said base frequency and said lowest order bit;

wherein said comparison means includes an exclusive OR gate and said incrementing means includes an incrementer, one input of said exclusive OR gate being coupled to said base frequency means and the other input of said exclusive OR gate being coupled to the least significant bit output line from said note memory, the output of said exclusive OR gate being coupled to one input of said incrementer, the other inputs of said incrementer being coupled to the outputs of said note memory, whereby the output of said exclusive OR gate is added to the addressed contents of said note memory to create a word representative of the pitch of the base frequency where each higher order bit is a lower octave of said base frequency, and octaves of each said base frequencies are generated for simultaneous output.

2. The apparatus of claim 1 further comprising:

a note-list memory for storing addresses of selected words in said note memory and corresponding octave field codes;

note address means for successively reading every address and octave field in said note-list memory and for addressing a selected bit from said selected words in said note memory; and output means for adding each said selected bit and generating a sum output signal, whereby arbitrary waveforms may be generated from said base frequencies.

3. The apparatus of claim 2 wherein said base frequency means is a top octave generator for producing a chromatic series of pitches.

4. The apparatus of claim 2 wherein said output means comprises:

a multiplexer having its inputs coupled to said note memory;

an accumulator having its input coupled to said multiplexer;

digital-to-analog conversion means coupled to said accumulator for selectively generating an analog signal from a digital input; and control means coupled to said digital-to-analog means for enabling said digital-to-analog means when said accumulator has reached a final value.

5. The apparatus of claim 4 wherein said control means is a counter used to address and read-out the entire contents of said note-list memory.

* * * * *